US006848588B2

(12) United States Patent
DeNatale, Jr.

(10) Patent No.: US 6,848,588 B2
(45) Date of Patent: Feb. 1, 2005

(54) ROTATING DISPLAY HOLDER FOR VCR TAPES, DVD'S AND VIDEO GAMES

(75) Inventor: John DeNatale, Jr., 81-17 Beaver Spur, Moriches, NY (US) 11955

(73) Assignee: John DeNatale, Jr., Moriches, NY (US)

( * ) Notice: Subject to any disclaimer, the term of this patent is extended or adjusted under 35 U.S.C. 154(b) by 0 days.

(21) Appl. No.: 10/730,225

(22) Filed: Dec. 8, 2003

(65) Prior Publication Data

US 2004/0112853 A1 Jun. 17, 2004

Related U.S. Application Data

(63) Continuation of application No. 10/128,620, filed on Apr. 23, 2002, now abandoned.

(51) Int. Cl.[7] ..... A47F 5/02; A47G 29/00

(52) U.S. Cl. ..... 211/163; 211/40; 211/78

(58) Field of Search ..... 211/163, 40, 41.12, 211/131.1, 49.1, 78, 58, 1.52, 95; 312/9.45, 9.46, 9.9, 9.48, 9.52, 125, 135; D6/407; 206/307, 309, 308.3, 387.1, 387.15, 307.1

(56) References Cited

U.S. PATENT DOCUMENTS

| | | | | | |
|---|---|---|---|---|---|
| 2,690,843 | A | * | 10/1954 | Ament | 211/40 |
| 3,170,741 | A | * | 2/1965 | Richards, Jr. | 312/9.46 |
| 3,334,950 | A | * | 8/1967 | Brownlee | 211/40 |
| 3,608,739 | A | * | 9/1971 | Duboff | 211/40 |
| 3,692,376 | A | * | 9/1972 | McKinsey et al. | 312/9.46 |
| 3,868,916 | A | * | 3/1975 | Ohlson | 108/103 |
| 3,998,334 | A | * | 12/1976 | Smith | 211/45 |
| 4,014,437 | A | * | 3/1977 | Rumble et al. | 211/4 |
| 4,453,326 | A | * | 6/1984 | Hoffman et al. | 40/377 |
| D296,277 | S | | 6/1988 | Hardy | D6/457 |
| 4,826,261 | A | * | 5/1989 | Nademlejnsky | 312/9.46 |
| 5,031,779 | A | | 7/1991 | Szenay | 211/40 |
| 5,176,264 | A | * | 1/1993 | De Palma | 211/40 |
| 5,188,240 | A | | 2/1993 | Marino | 211/41 |
| 5,297,675 | A | * | 3/1994 | Martucci | 206/307.1 |
| 5,385,397 | A | | 1/1995 | Chow | 312/9.45 |
| 5,524,775 | A | * | 6/1996 | Kaine | 211/131.1 |

(List continued on next page.)

*Primary Examiner*—Carl D. Friedman
*Assistant Examiner*—Jennifer E. Novosad

(57) ABSTRACT

A rotating display holder for VCR tapes, DVD's, and video games. The holder is round and contains multiple sleeves or compartments to hold the above media items, such that the user can easily read the title of each on the spine of the item. In the preferred mode of production, the compartments are spaced apart from one another so that the user can easily place his or her fingers around the tape or DVD to conveniently pull the item from the holder. Importantly, the rotatable holder can hold a mix of VCR tapes and DVD's or games, saving a great deal of space for the user. Therefore, the holder can be placed in a cabinet with shelves for VCR's or DVD players, as well as in a wall unit or entertainment center. The rotatable holder may be produced in several sizes, such as a small and large size, and the holders can be stacked on top of one another to hold large collections of tapes, DVD's, and games. In addition, the rotatable holder may be motorized and remotely controlled. This allows the user to spin the holder to easily locate a particular item contained within. Finally, specialized cabinets may be made for the rotatable holder, providing a compact means to hold a variety of items in an attractive manner.

7 Claims, 4 Drawing Sheets

U.S. PATENT DOCUMENTS 5,547,085 A * 8/1996 Gaus ..... 211/40
5,566,839 A 10/1996 Muller ..... 211/40
5,584,391 A * 12/1996 Weisburn ..... 206/387.15
5,669,494 A * 9/1997 Geffen ..... 358/1.15
5,685,423 A * 11/1997 Hunt ..... 206/307.1
5,749,477 A 5/1998 Chang ..... 211/40
D404,958 S 2/1999 Cheris ..... D6/630
5,964,356 A * 10/1999 Gareau et al. ..... 211/40
D420,239 S 2/2000 Nemeth ..... D6/630
D434,229 S 11/2000 Van den Branden ..... D3/314
6,149,019 A 11/2000 Newman ..... 211/40
D438,049 S 2/2001 Demeter ..... D6/630
6,215,264 B1 * 4/2001 Ma ..... 318/293
6,464,088 B1 * 10/2002 Caplan et al. ..... 211/40

* cited by examiner

ROTATING DISPLAY HOLDER FOR VCR TAPES, DVD'S AND VIDEO GAMES

This is a continuation-in-part of application Ser. No. 10/128,620, filed Apr. 23, 2002.

BACKGROUND OF THE INVENTION

1. Field of the Invention

The present invention relates to a rotating display holder for VCR tapes, DVD's, and video games, containing multiple sleeves or compartments to hold the media items, such that the user can easily read the title of each on the spine of the item.

2. Description of the Prior Art

Numerous holders for tape and game holders have been provided in the prior art that are described as follows. Even though these innovations may be suitable for the specific individual purposes to which they address, they differ from the present invention as hereinafter contrasted. The following is a summary of those prior art patents most relevant to the invention at hand, as well a description outlining the differences between the features of the present invention and those of the prior art.

1. U.S. Design Pat. No. Des. 404,958, Invented by Cheris et al., Entitled "Rotatable Holder For Compact Discs, CD-Roms, and Other Discs"

The design patent to Cheris depicts a rotatable holder for compact discs, CD-roms, and other discs, as shown and described.

2. U.S. Pat. No. 5,566,839, Invented by Muller, Entitled "Stand for Holding Objects of the Same Shape"

In the patent to Muller, a stand for holding compact discs and/or tape cassettes preferably has a rotatably mounted part made up of a multiplicity of bar-shaped elements of two different types. These elements have transverse grooves enabling them to be fitted one on the other in parallel pairs, with alternate pairs at right angles to each other, thus giving two pairs of parallel walls. The elements also have longitudinal ribs located opposite each other in pairs, thus providing lateral supports for the objects. The individual components can be provided as a kit which enables the stand to be transported and distributed in unassembled form. A second, smaller, part, can be mounted on the first and connected to it. This second part is designed to hold differently shaped objects, such as audio cassettes.

3. U.S. Pat. No. 5,188,240, Invented by Marino et al., Entitled "Storage Unit for Recording-Media Boxes"

The Marino invention describes a storage unit or rack for recording-media boxes such as CD boxes or other such containers which rack supports the boxes in a series of parallel substantially horizontal planes or in planes inclined at some other angle. The rack has one or more pairs of sidewalls lying in planes which intersect at right angles and which engage two adjacent side edges of each box and leave the other two side edges of each box facing outwardly and exposed so that they are visible for reading labels on the boxes and to provide easy access for placement and removal of such boxes.

4. U.S. Pat. No. 5,749,477, Invented by Chang, Entitled "Video/Audio Medium Rack"

The patent to Chang describes a video/audio medium rack at least including four connecting rods, four wall boards and a back board. The wall boards are disposed with tenons interlacedly engaged with engaging slots of the connecting rods so as to assemble the wall boards with the connecting rods. The back board is formed with peripheral stopper edge for fitting into channels of the wall boards so as to assemble the back board with the wall boards. CDs and VHS tapes can be both rested in the rack. Several racks can be stacked or assembled to enlarge the capacity of the rack. A base is disposed under the bottom of the rack and rotatably fitted with a bottom dish, whereby the base together with the rack can be rotated relative to the bottom dish.

5. U.S. Pat. No. 5,385,397, Invented by Chow, Entitled "Stackable Compact Disc Carousel"

In the patent to Chow, a stackable storage rack receives thin, flat objects such as compact disc cases. The rack includes a turntable with radially extending grooves for receiving the objects. The base has portions thereof extending radially outwards beyond the turntable. There is a spindle and bearing for rotatably mounting the turntable on the base. A plurality of elongated rods extend perpendicularly from the top of the base on the portions thereof. There are sockets on the bottom of the base for releasibly receiving tops of rods of another rack. A plurality of racks can thereby be stacked one upon the other.

6. U.S. Design Pat. No. D438,049, Invented by Demeter, Entitled "Combined Storage and Automatic Retrieval Apparatus for Recorded Media"

The design patent to Demeter depicts the ornamental design for a combined storage and automatic retrieval apparatus for recorded media, as shown and described 7. U.S. Design Pat. No. Des. 296,277, Invented by Hardy, Entitled "Rotatable Merchandising Display Stand"

The design patent to Hardy depicts the ornamental design for a rotatable merchandising display stand, as shown and described.

8. U.S. Design Pat. No. Des. 420,239, Invented by Nemeth, Entitled "Zip Disk Tower"

The design patent to Nemeth depicts the ornamental design for a Zip Disk Tower, as shown and described.

9. U.S. Design Pat. No. Des. 434,229, Invented by Van den Branden et al., Entitled "Storage Box"

The design patent to Van den Branden et al., describes the ornamental design for a Storage Box, as shown and described.

10. U.S. Pat. No. 6,149,019, Invented by Newman, Entitled "Modular Library System (Compact Disc Housing Unit)"

In the patent to Newman, a modular library system, compact disc holder comprises a main housing unit with a lower plate, an upper plate, a pair of opposing side walls, and a rear wall. In addition, the main housing includes an inner retractable plate. Mounted on the inner retractable plate is an inner unit, with a turntable in between, allowing for 180 degree rotation when the inner retractable plate is fully extended. Accordingly, the retractable inner unit is comprised of a lower plate, an upper plate, a pair of opposing side walls, and two inner walls parallel to the opposing side walls. Housed within the inner unit are six individual smaller units, which have a series of elongated ribs, providing storage slots for CD's. Each of these six individual smaller units can be removed and relocated as desired. The dimensions of the compact disc housing unit were designed to fit into the bottom of most stereo rack systems, although it may stand alone, as well.

11. U.S. Pat. No. 5,031,779, Invented by Szenay, Entitled "Compact Disk Storage Carousel"

The patent to Szenay describes a carousel for storing and displaying compact disk albums or cases comprises one or more reels rotatably mounted on a turntable base where the reels include a central core and a pair of parallel spaced-apart disks having sets of parallel ribs disposed at equal angular positions around the core. The dimensions are such that the CD case readily fits between the pair of disks and are held upright by their engagement with the ribs formed on the disks. When a reel populated with a plurality of CD cases is placed on the base, it may be rotated so as to bring the cases into view for selection of a particular recording for play.

Generally, the prior patents illustrate various tape and disk holders, including: rotatable holders in a "tower" like shape; holders for small audio cassette tapes; holders that are small and portable; various holders that do not rotate; and various merchandise display racks for usage in stores and retail outlets.

Unlike the above, the present invention is a round rotating display that contains multiple sleeves to hold VCR tapes, DVD's, and video games vertically, such that the user can easily read the title of each on the spine of the item. Importantly, the invention can hold a mix of VCR tapes and DVD's or games, saving a great deal of space for the user in a cabinet, wall unit, or entertainment center.

The holder may be produced in small or large size, and holders can be stacked on top of one another to save more space. The rotatable holder may also be motorized with a remote control to spin the holder to locate a particular tape or game. In addition, cabinets may be specially designed to contain the holders of the present invention. Such specialized cabinets may include shelves for VCRs and DVD players may also be made for the rotatable holder, providing a compact means to hold VCR tapes, DVD's, and games in an attractive manner that matches the surrounding décor.

SUMMARY OF THE INVENTION

As noted above, the present invention is a rotating display holder for VCR tapes, DVD's, and video games. The holder is round and contains multiple sleeves or compartments to hold the above media items, such that the user can easily read the title of each on the spine of the item. In the preferred mode of production, the compartments are spaced apart from one another so that the user can easily place his or her fingers around the tape or DVD to conveniently pull the item from the holder. Importantly, the rotatable holder can hold a mix of VCR tapes and DVD's or games, saving a great deal of space for the user. Therefore, the holder can be placed in a cabinet with shelves for VCR's or DVD players, as well as in a wall unit or entertainment center The rotatable holder may be produced in several sizes. The holders can be stacked on top of one another to hold large collections of tapes, DVD's, and games. In addition, the rotatable holder may be motorized and remotely controlled. This allows the user to spin the holder to easily locate a particular item contained within. Finally, specialized cabinets may be made for the rotatable holder, providing a compact means to hold a variety of items in an attractive manner.

Accordingly, it is an object of the invention to provide a device that effectively holds VCR tapes, DVD'S, and games in a space-saving manner.

It is an additional goal of the invention to provide a device that can be easily incorporated into or on top of a cabinet or wall unit in a den, living room, family room, or other area.

It is another object of the invention to provide a device that is manufactured of lightweight, relatively inexpensive materials, functioning to keep manufacturing and shipping costs to a minimum.

Furthermore, it is a goal of the present invention to provide a device that can be manufactured in small and large sizes.

It is an additional goal of the invention to provide a device that can include graphics thereon, as well as many colors thereon.

It is another object of the invention to provide a rotatable holder that may be powered and remotely controlled, allowing the user to cause the holder to rotate to view all contents thereof.

Finally, it is an important goal of the present invention to provide DVD, game, and VCR tape holders that can be easily stacked on top of one another, providing the user with a convenient means to store an entire collection of movies and games in a compact manner.

The novel features which are considered characteristic for the invention will be set forth in the claims when submitted. The invention itself, however, both as to its construction and its method of operation, together with additional objects and advantages thereof, will be best understood from the description of the embodiments to be submitted when read and understood in connection with drawings relating thereto.

BRIEF DESCRIPTION OF PREFERRED EMBODIMENTS

DETAILED DESCRIPTION OF PREFERRED EMBODIMENTS

Figure 1:
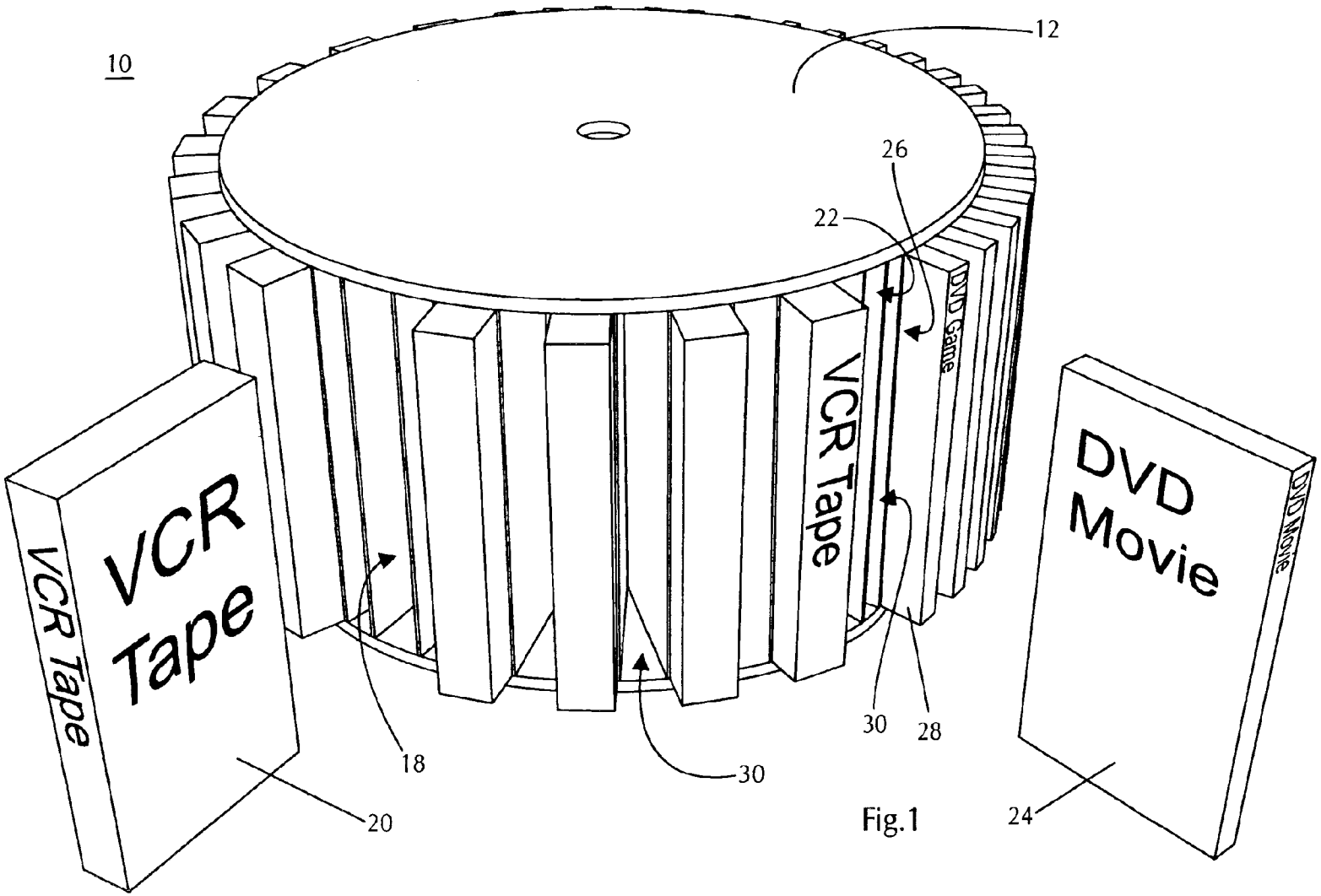
FIG. 1 is a three-quarter upper perspective view of the present invention, illustrating the principal components, shown for the purposes of example only.
Figure 2:
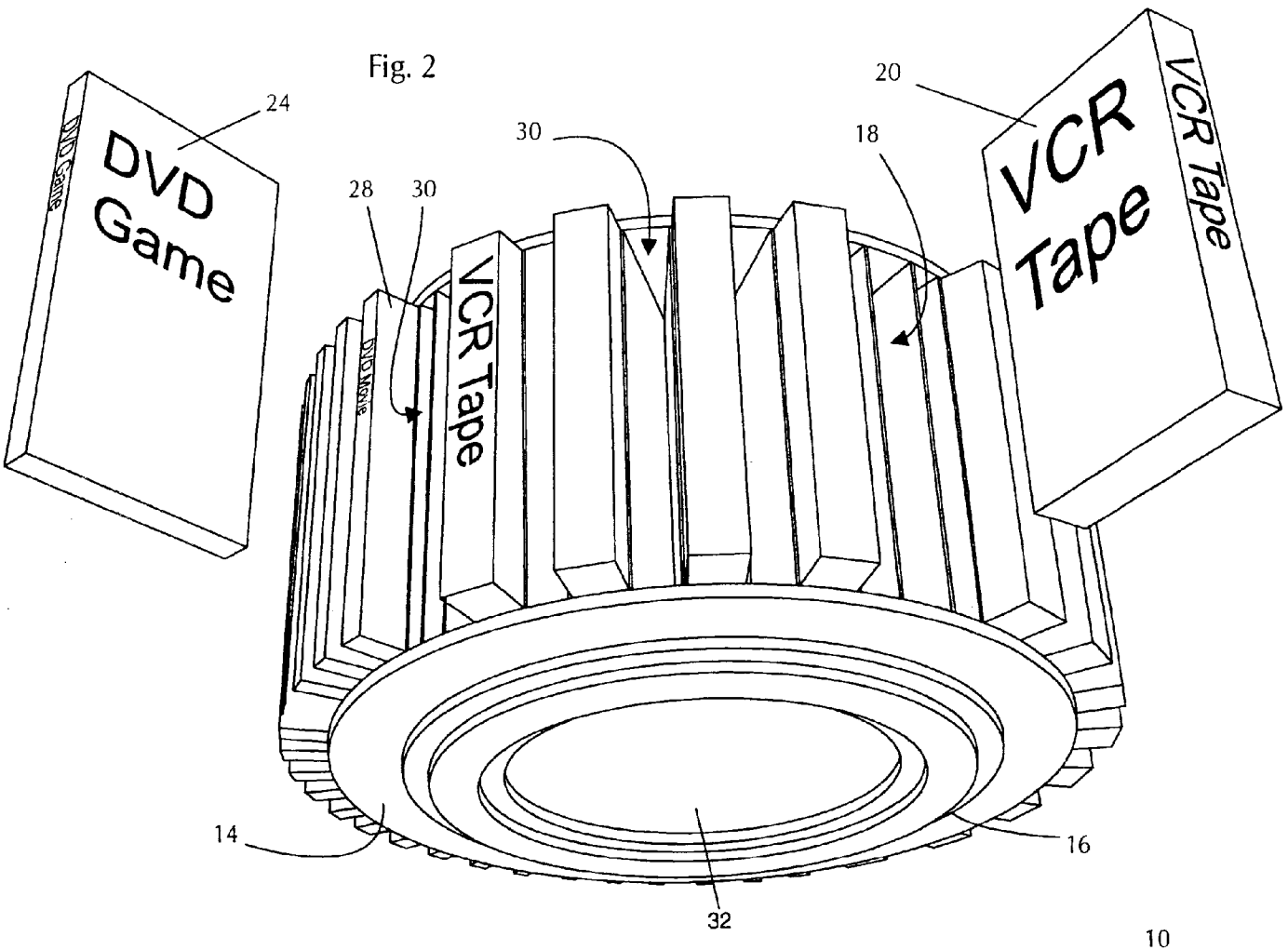
FIG. 2 is a three-quarter lower perspective view of the present invention, illustrating the principal components, including the rotating assembly, shown for the purposes of example only.

Regarding both FIG. 1, which is a three-quarter upper perspective view of the present invention, illustrating the principal components, shown for the purposes of example only, and FIG. 2, which is a three-quarter perspective view of the bottom of the present invention, illustrating the principal components, including the rotating assembly, shown for the purposes of example only.

In the preferred mode, the rotating VCR tape, DVD video, and DVD game holder (10) is round in shape and comprises a flat top surface (12), flat bottom surface (14), rotating assembly (16) located upon the bottom surface (14), multiple VCR tape compartments (18) on a first side, which each hold a VCR tape (20), multiple DVD movie compartments (22) on a second side, which each hold a DVD movie (24), as well as multiple DVD game compartments (26) which each hold a DVD game (28), and multiple spaces between compartments (30), which function to allow the user to place his or her fingers between the tapes or games to grab the same and pull them out of the compartments with ease.

In general, the holder may be manufactured in any of a variety of durable materials that accomplish the purposes of the invention. Each of the compartments (18, 22, 26) are of a width specially designed to securely hold VCR tapes or DVD's, and each is vertically oriented and adapted to receive VCR tapes, DVD's, and games such that the user can easily read the title of each VCR tape, DVD, and game on the spines thereof.

Specifically, the first compartments (18) are of a width of approximately 1¼ inches, and of a sufficient depth to allow portions of the VCR tapes inserted therein to extend beyond the periphery of the housing. The second compartments (22, 26) are of a width of approximately ¾ inches, and of a sufficient depth to allow portions of the DVD's and video games inserted therein to extend beyond the periphery of the housing.

Because the bottom (14) of the VCR tape, DVD video, and DVD game holder (10) is equipped with a rotating assembly (16), the entire housing may be easily rotated by the user to display all contents of the holder. Such rotating assembly (16) comprises multiple annular members which function to both engage the flat surface upon which the holder sits, and to allow the user to spin the holder freely either manually or automatically.

Furthermore, the compartments (18, 22, 26) are of a sufficient depth to allow portions of the VCR tapes, DVD's, and games inserted therein to extend beyond the housing. In addition, the compartments (18, 22, 26) are sufficiently spaced apart from one another to create spaces therebetween (30). Such spaces (30) allow the user to easily place the user's fingers around the VCR tape, DVD, or game to pull the VCR tape, DVD, or game from the holder.

It should be noted that the rotating VCR tape, DVD video, and DVD game holder (10) may be manufactured in a variety of sizes to hold varying quantities of VCR tapes (20), DVD movies or other videos (24), and DVD games (28).

In one embodiment, the holder (10) is small in nature and comprises compartments to hold 11 DVD's and 11 VCR tapes. For the purposes of example, this small embodiment may be of a diameter of approximately 16 inches and may be of a height of approximately 8½ inches.

In the next embodiment, the holder (10) is large in nature and comprises compartments to hold 16 DVD's and 16 VCR tapes. For the purposes of example, this large embodiment may be of a diameter of approximately 20 inches, but may still be of a height of approximately 8½ inches.

In a third embodiment, the holder may be small in nature and designed to contain only VCR tapes, and in a fourth embodiment, the holder may be large in nature and designed to contain only VCR tapes, such as a quantity of 30 total VCR movies.

Likewise, in a fifth embodiment, the holder may be small in nature and designed to contain only DVD's, and in a sixth embodiment, the holder may be large in nature and designed to contain only DVD's.

Figure 3:
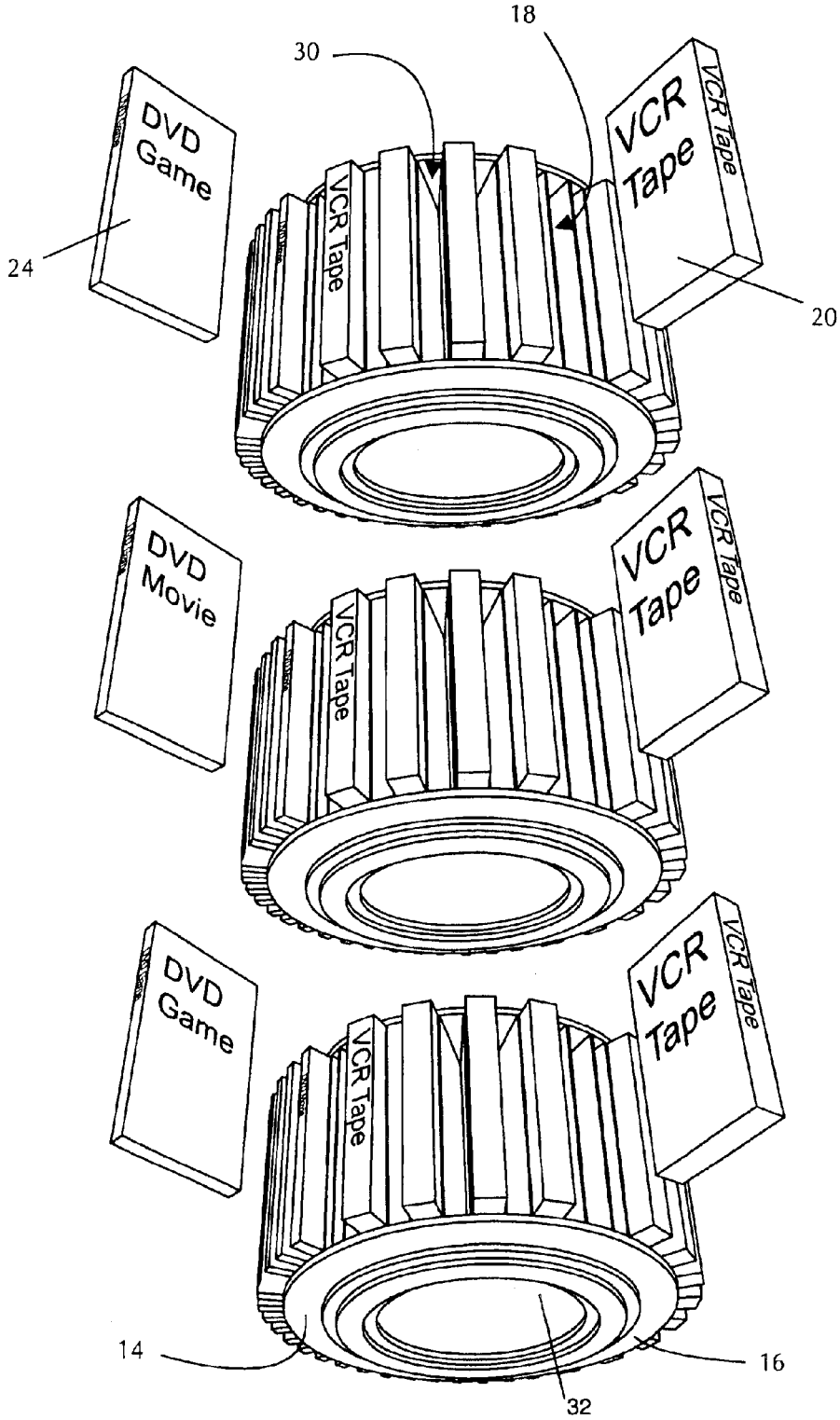
FIG. 3 is an exploded lower view of multiple rotating display holders stacked atop one another.

Importantly, in each of the six above examples, the holders may be designed to be stackable atop one another and rotate. For example, as illustrated in FIGS. 3 and 4, two or more identical holders may be stacked atop one another such that users with large collections in the form of a single media can conveniently store their entire collection within such holders.

Similarly, users with collections that include a mix of VCR tapes, DVD movies, and DVD games may stack different embodiments of the present invention atop one another, such that the user can store and display their entire multi-media collection through usage of the holders.

Moreover, unlike the holders of the prior art, the rotatable holder of the present invention can hold a mix of VCR tapes and DVD's or games, saving a great deal of space for the user. In fact, the rotatable holder can be placed in a cabinet with shelves for VCR's or DVD players, as well as in a wall unit or entertainment center. Such cabinets may be specially manufactured for usage in conjunction with the holders of the present invention, such as by including sufficient width and height for several such holders to be placed therein.

Figure 4:
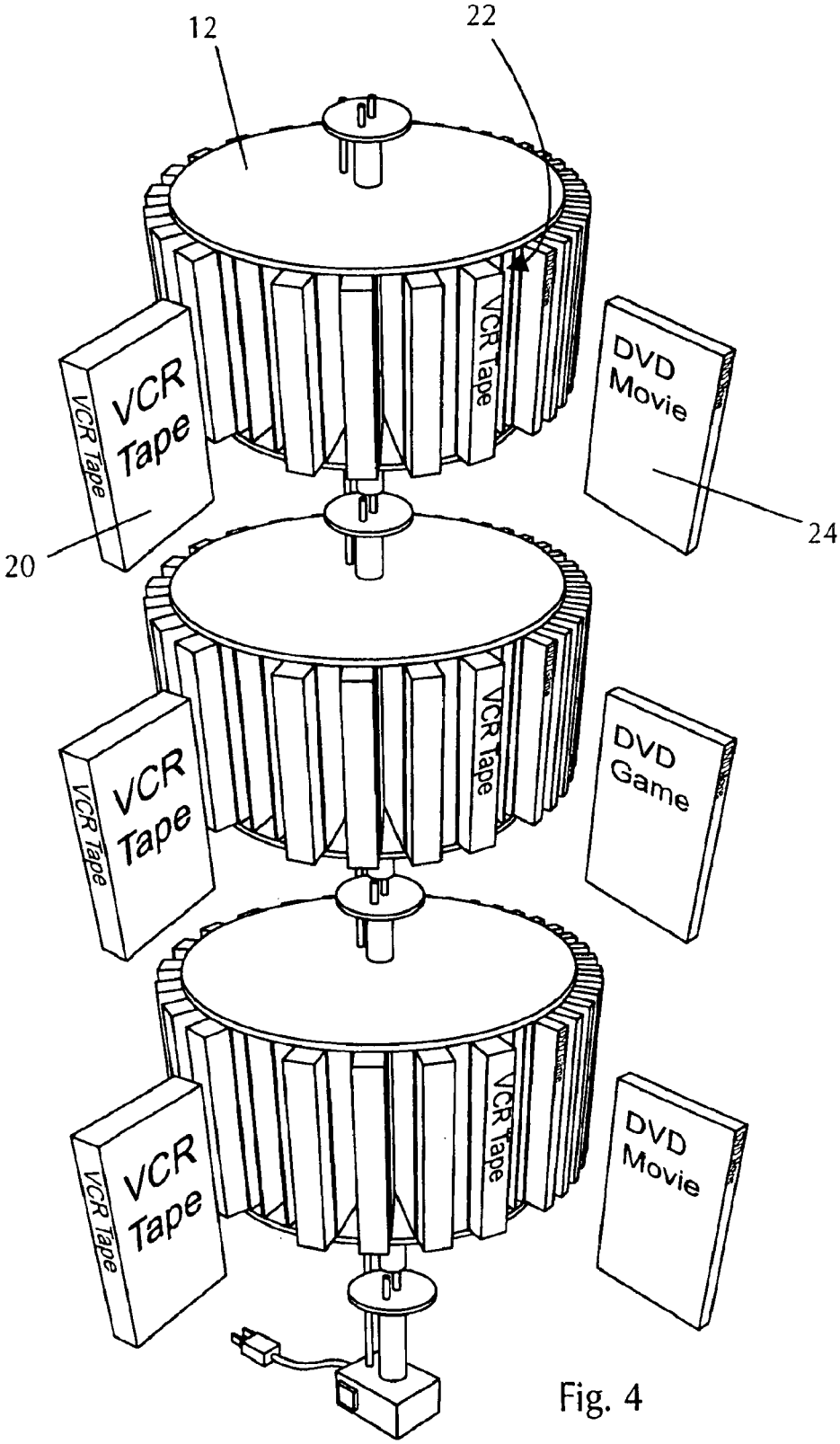
FIG. 4 is an exploded upper view of multiple rotating display holders stacked atop one another, including the location of the motorized means, for the purposes of example.

Regarding further versatility of the present invention, the rotating display holder for VCR tapes, DVD's, and video games may be motorized, as illustrated in FIG. 4. In such an instance, the holder may be remotely controlled, allowing the user to cause the holder to automatically rotate to a previously determined degree, to allow the user to easily locate a particular item contained within.

In addition, in an enhanced alternate version, the rotating display holder may be customized by a user and able to be adapted to a user's particular needs. Such may be accomplished by the user inserting panels in slots to create compartments of a desired size.

For the purposes of example, a user may have 20 VCR tapes and 6 DVDs, and can set their storage system accordingly. Later, the user may replace several of his or her VCR tapes with DVDs, and then be able to reconfigure the rotating display holder accordingly. As such, the device may comprise many slots, and may come with a supply of appropriate panels.

Therefore, in total, the present invention provides a unique means to conveniently store collections of a variety of movies and games in a compact and aesthetically-pleasing manner.

With regards to all descriptions and graphics, while the invention has been illustrated and described as embodied, it is not intended to be limited to the details shown, since it will be understood that various omissions, modifications, substitutions and changes in the forms and details of the device illustrated and in its operation can be made by those skilled in the art without departing in any way from the spirit of the invention.

Without further analysis, the foregoing will so fully reveal the gist of the present invention that others can readily adapt it for various applications without omitting features that, from the standpoint of prior art, constitute essential characteristics of the generic or specific aspects of this invention. What is claimed as new and desired to be protected by Letters Patent is set forth in the appended claims.

What is claimed is:

1. A system comprising at least one rotatable display holder in combination with video cassette recorder (VCR) tapes each having a first size, digital video disks (DVD's), and video games whereby the DVD's and video games each have a second size which is different than the first size, the holder comprising:

a generally round housing which comprises a flat bottom and flat top, and the housing further comprising a plurality of first compartments along a first side of the housing which defines approximately half of the periphery of the housing and a plurality of second compartments along a second side of the housing which defines approximately the other half of the periphery of the housing;

the first compartments each having a forward opening and being vertically oriented between the top and bottom of the housing, and each of the first compartments having a height of 8½ inches and a width of approximately 1¼ inches and receiving and holding only the VCR tapes, such that the forward openings lie along the periphery of the housing so that a user can read a title of each VCR tape on spines thereof, and whereby portions of the VCR tapes inserted therein extend beyond the periphery of the housing, the first compartments juxtaposed to allow the user to place the user's fingers around the VCR tape to pull the VCR tape from the holder;

the second compartments each having a forward opening and being vertically oriented between the top and bottom of the housing, and each of the second compartments having a height of 8½ inches and a width of approximately ¾ inches and receiving and holding only the DVD'S or video games, such that the forward openings lie along the periphery of the housing so that a user can read a title of each DVD and video game on spines thereof, and whereby portions of the DVD'S and video games inserted therein extend beyond the periphery of the housing, the second compartments juxtaposed to allow the user to place the user's fingers around the DVD'S and video games to pull the DVD'S and video games from the holder; and the at least one rotatable display holder further being adapted to receive an additional rotatable display holder on the flat top thereof, resulting in a stacking of rotatable display holders for holding additional VCR tapes, DVD'S and video games.

2. The system of claim 1, wherein the at least one rotatable display holder is motorized.

3. The system of claim 2, wherein the at least one rotatable display holder is remotely controlled, allowing the user to cause the holder to automatically rotate to allow the user to locate a particular item contained within.

4. The system of claim 1, wherein the at least one rotatable display holder is manufactured of wood.

5. The system of claim 1, wherein the at least one rotatable display holder is manufactured of metal.

6. The system of claim 1, wherein the at least one rotatable display holder has a diameter of 16 inches which holds 11 VCR tapes and 11 DVD's or video games.

7. The system of claim 1, wherein the at least one rotatable display holder has a diameter of 20 inches which holds 16 VCR tapes and 16 DVD's or video games.

* * * * *